US009278533B2

(12) United States Patent
Shimazu

(10) Patent No.: US 9,278,533 B2
(45) Date of Patent: Mar. 8, 2016

(54) LIQUID EJECTING APPARATUS

(71) Applicant: SEIKO EPSON CORPORATION, Tokyo (JP)

(72) Inventor: Masamitsu Shimazu, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/716,710

(22) Filed: May 19, 2015

(65) Prior Publication Data

US 2015/0336386 A1 Nov. 26, 2015

(30) Foreign Application Priority Data

May 20, 2014 (JP) ..... 2014-104054

(51) Int. Cl.
*B41J 2/165* (2006.01)

(52) U.S. Cl.
CPC ..... *B41J 2/16523* (2013.01)

(58) Field of Classification Search
USPC ..... 347/171, 215, 217–219, 220, 222; 400/223, 235, 611
See application file for complete search history.

(56) References Cited

U.S. PATENT DOCUMENTS

| | | | |
|---|---|---|---|
| 6,779,860 | B1 | 8/2004 | Hara et al. |
| 2004/0051755 | A1 | 3/2004 | Kanamitsu et al. |

FOREIGN PATENT DOCUMENTS

| | | |
|---|---|---|
| JP | 2000-203045 | 7/2000 |
| JP | 2004-142125 | 5/2004 |
| JP | 2005-035127 | 2/2005 |
| JP | 2006-181939 | 7/2006 |

*Primary Examiner* — Kristal Feggins
(74) *Attorney, Agent, or Firm* — Workman Nydegger

(57) ABSTRACT

A liquid ejecting apparatus includes a liquid ejecting unit which ejects a liquid onto a medium being transported in a state in which an edge portion thereof is aligned with a second end side of a first end and the second end in a width direction intersecting a transport direction of a transport path, a first reception section which receives the liquid discharged from the liquid ejecting unit as a waste liquid, a second reception section which receives the liquid ejected from the liquid ejecting unit toward the edge portion and is not received by the medium as the waste liquid, and a waste liquid holding section which holds the waste liquid, the waste liquid holding section including an inlet to guide the waste liquid received by the first reception section.

10 Claims, 7 Drawing Sheets

LIQUID EJECTING APPARATUS

BACKGROUND

1. Technical Field

The present invention relates to a liquid ejecting apparatus such as a printer.

2. Related Art

An example of the liquid ejecting apparatus is an ink jet printer which performs borderless printing in which a margin in not left at edge portions of paper by ejecting an ink from nozzles which are provided in a liquid ejecting head such that a margin is not left at the edge portions of the paper. There is a printer, of those that perform borderless printing, in which grooves are provided in a platen that supports the paper, a waste liquid tray is provided underneath the platen, ink droplets that fall outside of the edge portions of the paper are received by an absorbent material that is disposed in the grooves, and the ink that is received by the absorbent material is guided into the waste liquid tray (for example, JP-A-2004-142125).

In the printer described above, there is a case in which the ink is discharged from the nozzles into a cap member or the like that is disposed on the outside of a transport path of the paper in order to prevent or solve nozzle clogging. In this case, the problem is to efficiently collect the ink (the waste liquid) that is discharged through the grooves provided in the platen which is disposed in the transport path of the paper, and the ink (the waste liquid) that is discharged from the cap member which is disposed outside of the transport path of the paper.

Note that, this problem is not limited to a printer which performs printing by ejecting an ink, and is generally common in liquid ejecting apparatuses which collect a liquid that is discharged from a liquid ejecting unit for maintenance in addition to the liquid that is ejected from the liquid ejecting unit toward the medium supporting section.

SUMMARY

An advantage of some aspects of the invention is to provide a liquid ejecting apparatus capable of efficiently collecting a waste liquid which is generated inside an apparatus.

Hereinafter, means of the invention and operation effects thereof will be described.

A liquid ejecting apparatus includes a liquid ejecting unit which, when a direction intersecting a transport direction is a width direction, ejects a liquid onto a medium which is transported in a transport direction in a state in which an edge portion position thereof is aligned with a second end side of a first end and the second end in the width direction of a transport path, a first reception section which is disposed outside of the first end of the transport path and receives the liquid that is discharged from the liquid ejecting unit as a waste liquid, a medium supporting section which includes support protruding portions which support the medium and a second reception section which receives the liquid that is ejected from the liquid ejecting unit toward the edge portion of the medium and is not received by the medium as the waste liquid, and a waste liquid holding section which holds the waste liquid that is received by the first reception section and the second reception section, in which the waste liquid holding section includes a holding chamber which holds the waste liquid vertically beneath the medium supporting section, an inlet which is disposed in a position closer to the first end than the second end in order to guide in the waste liquid that is received by the first reception section, and an opening portion which is open toward the second reception section.

In this case, since the inlet of the waste liquid holding section is disposed in a position closer to the first end than the second end, it is possible to efficiently guide the waste liquid that is discharged from the first reception section which is disposed outside of the first end of the transport path into the holding chamber through the inlet. Since the opening portion of the waste liquid holding section is open toward the second reception section, it is possible to efficiently guide the waste liquid that is received by the second reception section into the holding chamber through the opening portion. Since the medium is transported in a state in which the edge portion position thereof is aligned with the second end side of the transport path, there is a high likelihood that more of the waste liquid will be generated at a position closer to the second end than the first end in the transport path. Therefore, in the holding chamber, the waste liquid that is generated within the transport path is collected in a prioritized manner at a position near to the second end, and the waste liquid that is generated outside of the transport path is collected in a prioritized manner at a position near to the first end. Therefore, it is possible to efficiently collect the waste liquid that is generated within the apparatus.

The liquid ejecting apparatus further includes a transport unit which is disposed to be adjacent to the medium supporting section in the transport direction and transports the medium, in which the inlet of the waste liquid holding section is disposed vertically below the transport unit.

In this case, by disposing the inlet of the waste liquid holding section vertically below the transport unit, it is possible to secure a wide space for disposing the holding chamber vertically beneath the medium supporting section.

The liquid ejecting apparatus further includes a liquid guiding portion, a base end of which is connected to the second reception section and a distal end of which is inserted into the opening portion, in which the liquid guiding portion is disposed in a position at which the distal end is further from the inlet than the base end in the direction intersecting a vertical direction.

In this case, by allowing the waste liquid to travel from the base ends toward the distal end of the liquid guiding portion, it is possible to guide the waste liquid that is received by the second reception section into the holding chamber through the opening portion. Since the liquid guiding portion is disposed in a position at which the distal end is further from the inlet than the base end in a direction intersecting the vertical direction, it is possible to distance the position at which the waste liquid that is generated in the transport path is held and the position at which the waste liquid that is generated outside of the transport path in the waste liquid holding section. Accordingly, in the waste liquid holding section, it is possible to efficiently hold the liquid that is ejected from the liquid ejecting unit toward the medium supporting section, and the waste liquid that is discharged from the liquid ejecting unit on the outside of the transport path of the medium.

In the liquid ejecting apparatus, the waste liquid holding section includes a holding concave portion which is open vertically upward, an absorbent body capable of absorbing the waste liquid that is held in the holding concave portion, and a space forming portion which forms a space between the absorbent body and the inlet, and the opening portion of the holding concave portion which is open vertically upward is the opening portion which is open toward the second reception section, and an internal space of the holding concave portion forms the holding chamber.

In this case, by allowing the waste liquid to flow into the space formed by the space forming portion, it is possible to perform the guiding of the waste liquid into the waste liquid holding section quicker than in a case in which the absorbent body in a position abutting the inlet is allowed to absorb the waste liquid. Due to the waste liquid that is guided in from the inlet spreading in the space that is formed between the absorbent body and the inlet, it is possible to increase the surface area of the absorbent body in contact with the waste liquid and to cause the absorption of the waste liquid by the absorbent body to progress quickly. Since, while the waste liquid that is discharged from the second reception section is absorbed from the top surface side of the absorbent body, the waste liquid that is discharged from the first reception section is absorbed from the bottom surface side of the absorbent body, it is possible to efficiently absorb the waste liquid that is generated inside of the transport path and the waste liquid that is generated outside of the transport path from positions that are distanced from each other in the absorbent body.

In the liquid ejecting apparatus, the space forming portion includes a pair of side walls which are disposed to face each other in the width direction, and the width direction is a longitudinal direction of the space forming portion and the inlet is provided in one of the side walls.

It is possible to efficiently increase the contact surface area of the absorbent body in relation to the waste liquid by allowing the waste liquid that is guided in from the inlet to spread in the longitudinal direction of the space forming portion.

In the liquid ejecting apparatus, the inlet is open toward a direction parallel to the width direction in the side wall that is near the first reception section, of the pair of side walls.

In this case, since the inlet is provided in the side wall that is close to the first reception section, of the pair of side walls, it is possible to shorten the flow path connecting the first reception section to the inlet in comparison to a case in which the inlet is provided in the side wall which is far from the first reception section. Since the inlet is open toward a direction parallel to the width direction, the flow path which connects the first reception section to the inlet is provided to extend from the inlet toward the direction parallel to the width direction. Conversely, when the inlet is open toward the upstream side or the downstream side in the transport direction, since the flow path is provided to extend along the transport direction, there is a high likelihood that the apparatus will be enlarged in the transport direction. In other words, by opening the inlet toward a direction parallel to the width direction, it is possible to suppress the enlargement of the apparatus in the transport direction.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, description will be given of the embodiment of the liquid ejecting apparatus with reference to the drawings. An example of the liquid ejecting apparatus is an ink jet printer which performs recording (printing) by ejecting an ink, which is an example of the liquid, on to a medium such as paper.

Figure 1:
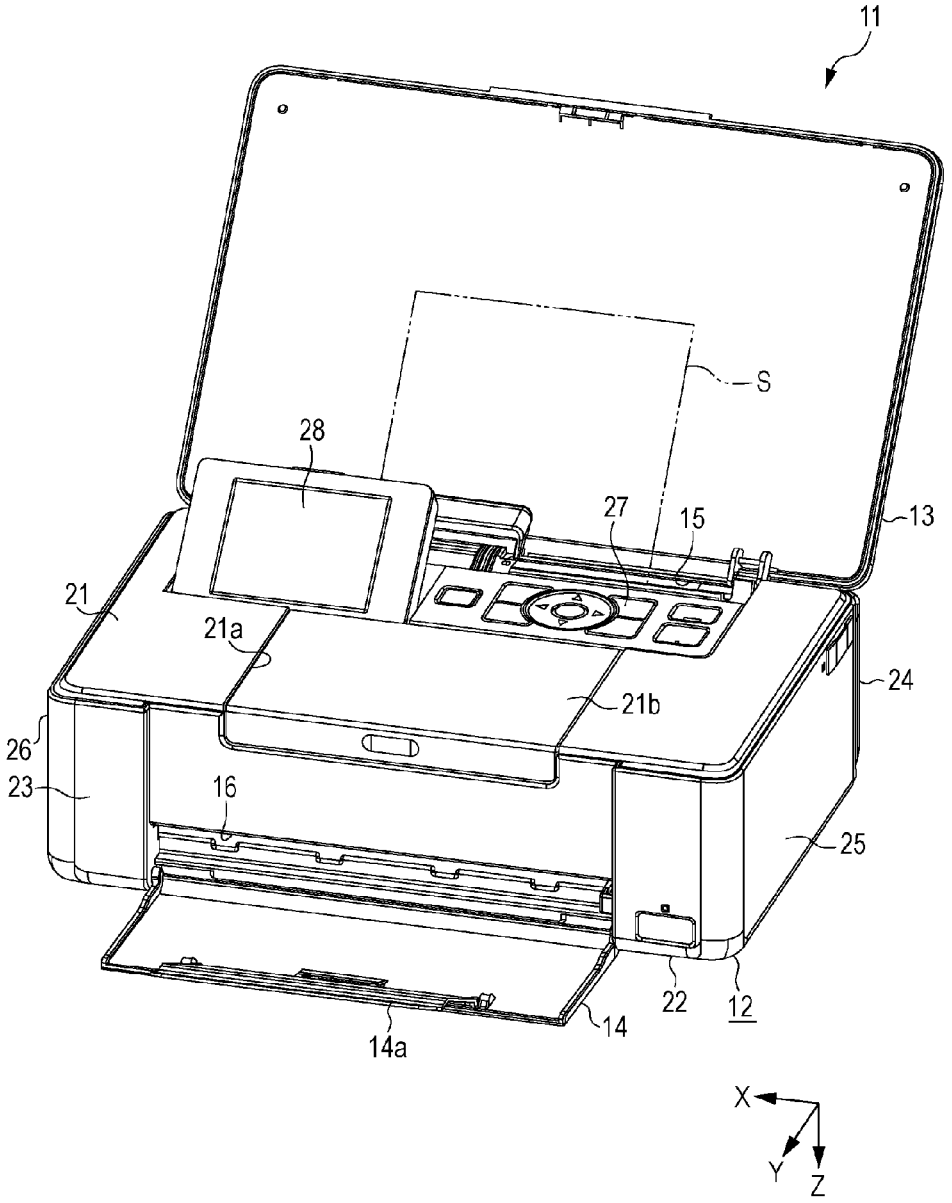
FIG. 1 is a perspective diagram of a liquid ejecting apparatus of an embodiment.

As illustrated in FIG. 1, a liquid ejecting apparatus 11 is provided with a rectangular box shaped housing section 12, a top lid 13, and a front lid 14. The top lid 13 is attached to be capable of moving rotationally in relation to the housing section 12, and the front lid 14 is similarly attached to be capable of moving rotationally in relation to the housing section 12. By moving rotationally to predetermined angles, the top lid 13 and the front lid 14 are disposed in closed positions overlapping the housing section 12, and open positions illustrated in FIG. 1.

When the top lid 13 is disposed in the open position, an insertion opening 15 for inserting a medium S into the housing section 12 is exposed. The top lid 13 that is disposed in the open position functions as a supporting base (a paper feed tray) which supports the medium S that is inserted into the insertion opening 15.

When the front lid 14 is disposed in the open position, a discharge opening 16 for discharging the medium S from inside the housing section 12 is exposed. The front lid 14 that is disposed in the opening position functions as a reception section (a paper discharge tray) which receives the medium S that is discharged from the discharge opening 16. An extending portion 14*a* for extending the length of a portion supporting the medium S is attached to the front lid 14 to be capable of moving rotationally.

In the housing section 12, an external wall in which the insertion opening 15 is opened is referred to as a top wall 21, an external wall of the opposite side from the top wall 21 is referred to as a bottom wall 22, an external wall in which the discharge opening 16 is opened is referred to as a front wall 23, and an external wall of the opposite side from the front wall 23 is referred to as a rear wall 24. In the housing section 12, a pair of external walls which intersect the top wall 21, the bottom wall 22, the front wall 23, and the rear wall 24 are referred to as external side walls 25 and 26. In the housing section 12, there is a case in which the top wall 21 side is referred to as the top surface side, and the bottom wall 22 side is referred to as the bottom surface side.

An operation unit 27 and a display unit 28 are disposed on the surface side (the top surface side) of the top wall 21. The operation unit 27 is for performing operation of the liquid ejecting apparatus 11 and the display unit 28 is for displaying the operation results of the operation unit 27, the operational state of the liquid ejecting apparatus 11, and the like.

An opening portion 21*a* is provided in the top wall 21, and an open-close lid 21*b* is attached to the opening portion 21*a*. The open-close lid 21*b* is disposed in a closed position or an open position by being moved rotationally to a predetermined angle. In the opening position, the open-close lid 21*b* covers the opening portion 21*a*, and in the open position, the open-close lid 21*b* exposes the opening portion 21*a*.

Figure 2:
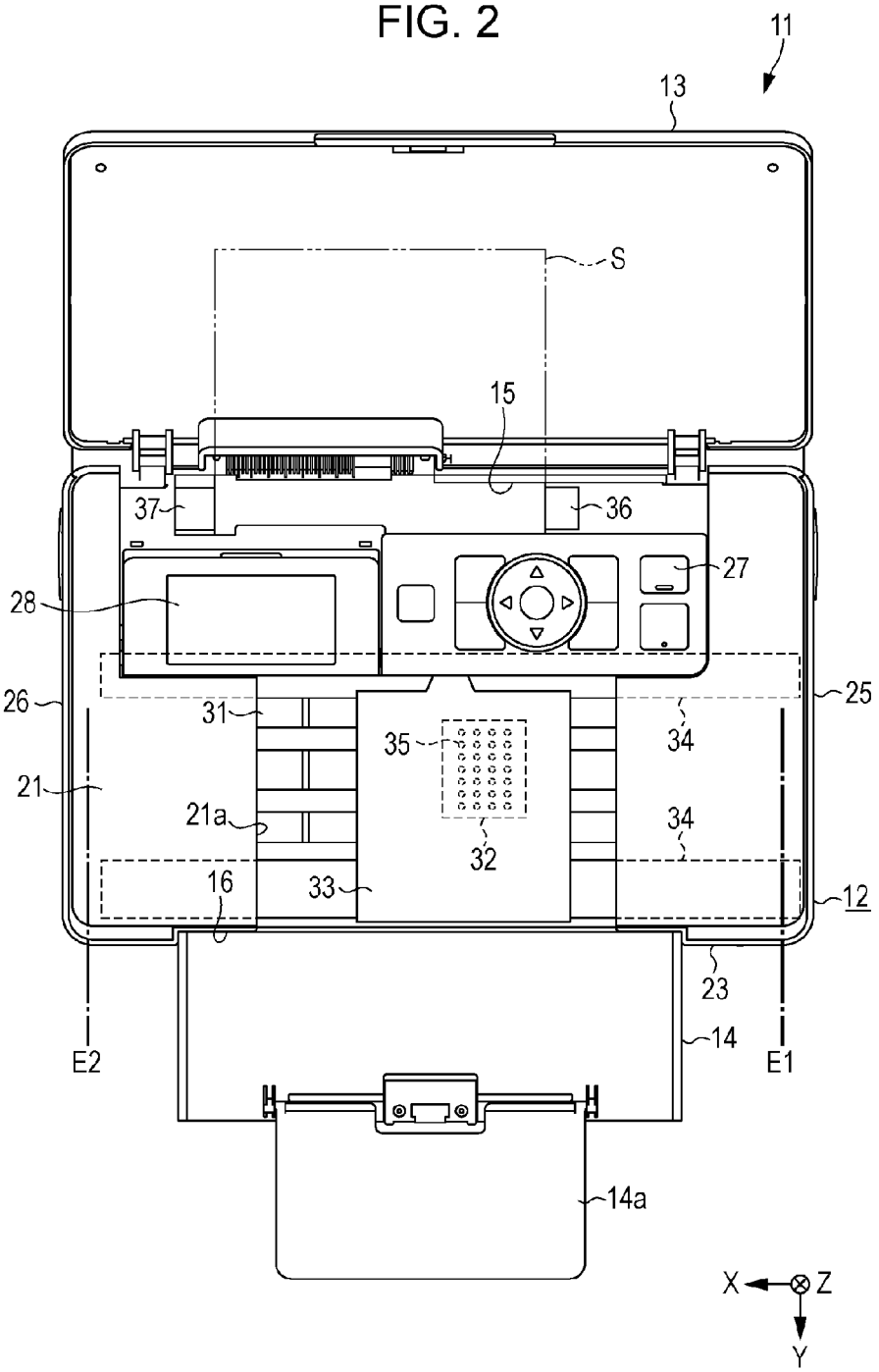
FIG. 2 is a top surface diagram of the liquid ejecting apparatus of FIG. 1.

As illustrated in FIG. 2, a medium supporting section 31, a liquid ejecting unit 32, and a carriage 33 are held in the housing section 12. The medium supporting section 31 is for supporting the medium S, the liquid ejecting unit 32 ejects a liquid onto the medium S that is supported on the medium supporting section 31, and the carriage 33 holds the liquid ejecting unit 32 and moved reciprocally. A guide rail 34 for guiding the movement of the carriage 33 is provided to bridge across the inside of the housing section 12. Note that, in FIG. 2, depiction of the open-close lid 21*b* is omitted in order to clearly illustrate the configuration inside the housing section 12.

The liquid ejecting unit 32 includes a plurality of nozzles 35 which eject the liquid as droplets. The liquid ejecting unit 32 uses a first end E1 side (the right end side in FIG. 2) in the longitudinal direction inside the housing section 12 as a home position (the position illustrated in FIG. 5), and alternately performs outgoing movement from the home position toward a second end E2 side (the left end side in FIG. 2) in the longitudinal direction, and return movement from the second end E2 side toward the home position.

In the present embodiment, the direction in which the liquid ejecting unit 32 ejects the liquid is referred to as an ejection direction Z, the direction in which the medium S is transported from the insertion opening 15 on the medium supporting section 31 toward the discharge opening 16 is referred to as a transport direction Y, and the return movement direction of the liquid ejecting unit 32 is referred to as a scanning direction X. The direction of the reciprocal movement of the liquid ejecting unit 32 (a direction parallel to the scanning direction X) is also referred to as a width direction of the medium S. In the present embodiment, the ejection direction Z is vertically downward (gravity direction), and the ejection direction Z, the transport direction Y, and the scanning direction X are directions that intersect (preferably that are orthogonal to) each other.

The insertion opening 15, the medium supporting section 31, and the discharge opening 16 line up in order from the upstream side toward the downstream side in the transport direction Y to form the transport path of the medium S. The medium supporting section 31 is disposed in the vicinity of the center in the scanning direction X inside the housing section 12. The home position is set to a position that is closer to the first end E1 than the medium supporting section 31. Guide sections 36 and 37 for determining the edge portion positions of the medium S in the scanning direction X in the transport path are provided in the insertion opening 15.

Figure 3:
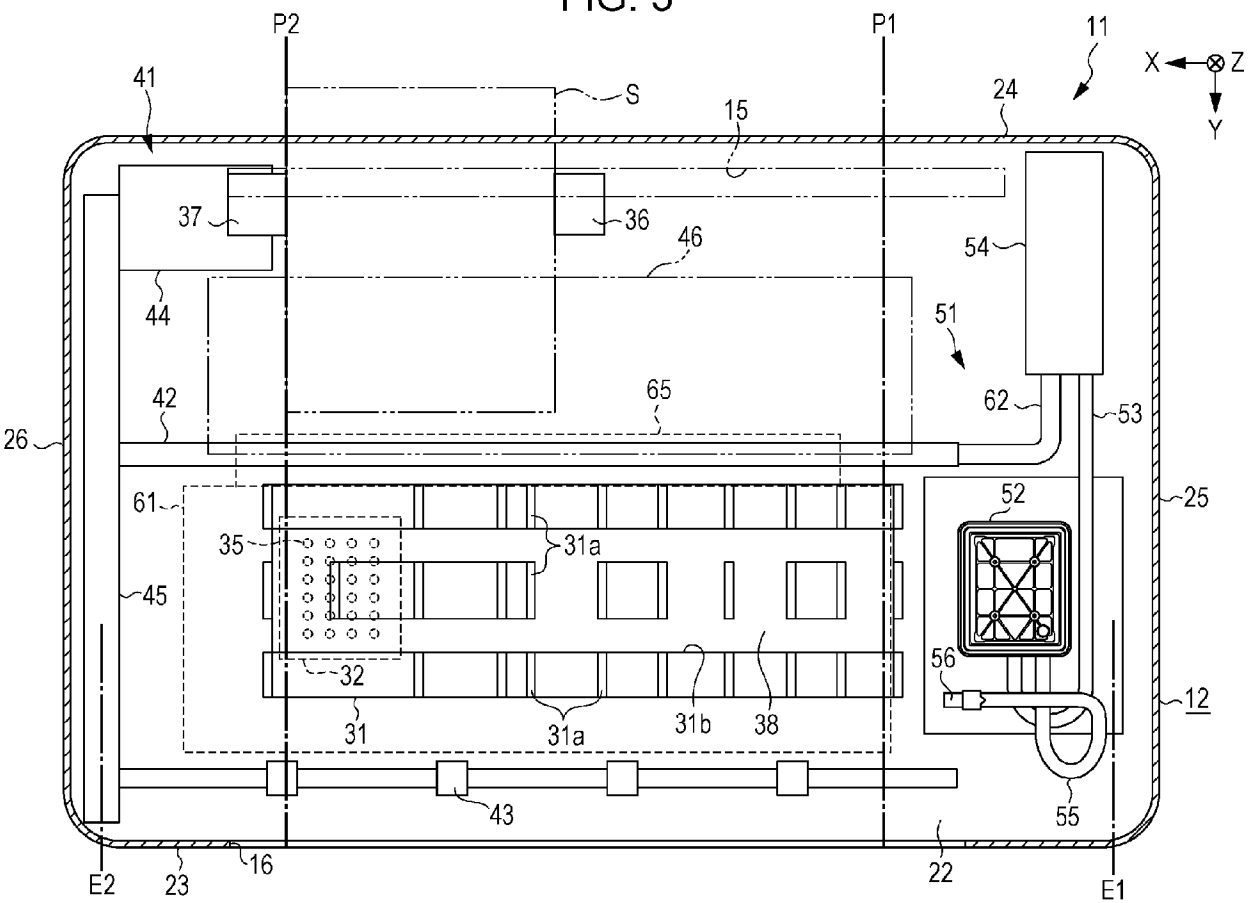
FIG. 3 is a schematic diagram illustrating planar configurations of a transport unit and a maintenance apparatus.

As illustrated in FIG. 3, the first guide section 36 determines the edge portion position of the first end P1 side (the right end side in FIG. 2) in the width direction of the medium S that is disposed in the transport path. The second guide section 37 determines the edge portion position of the second end P2 side (the left end side in FIG. 2) in the width direction of the medium S that is disposed in the transport path.

The first guide section 36 is capable of sliding movement along the scanning direction X, and causes the medium S to approach the second end P2 side of the transport path by moving in a direction (the scanning direction X) approaching the second end P2 while making contact with the first end P1 in the width direction of the medium S that is inserted into the insertion opening 15. The medium S is transported in a state of being positioned on the second end P2 side in the width direction in the transport path.

A transport unit 41, a maintenance mechanism 51, and a waste liquid holding section 61 are held inside the housing section 12. The transport unit 41 transports the medium S that is inserted from the insertion opening 15 toward the discharge opening 16, the maintenance mechanism 51 is for subjecting the liquid ejecting unit 32 to maintenance, and the waste liquid holding section 61 holds the liquid that is discharged from the liquid ejecting unit 32 as waste liquid.

The transport unit 41 is provided with a transport roller 42 and a discharge roller 43. The transport roller 42 transports the medium S from the insertion opening 15 toward the medium supporting section 31, and the discharge roller 43 transports the medium S from the medium supporting section 31 toward the discharge opening 16. The transport unit 41 is provided with a transport motor 44, a power transmission mechanism 45, and a transport path forming member 46. The transport motor 44 is a drive source, the power transmission mechanism 45 is formed of a gear train or the like for transmitting the driving power of the transport motor 44 to the transport roller 42 and the discharge roller 43, and the transport path forming member 46 forms the transport path of the medium S between the insertion opening 15 and the medium supporting section 31. The transport roller 42 is formed of a metal bar, the surface roughness of which is adjusted using surface finishing, for example.

The maintenance mechanism 51 is provided with a first reception section 52, a suction mechanism 54, a ventilation tube 55, and an atmosphere release valve 56. The first reception section 52 is disposed in a position corresponding to the home position, the suction mechanism 54 is connected to the first reception section 52 via a suction tube 53, a base end side of the ventilation tube 55 is connected to the first reception section 52, and the atmosphere release valve 56 is provided on a distal end side of the ventilation tube 55. The first reception section 52 of the present embodiment is a cap which is formed in the shape of a box with a bottom.

The suction mechanism 54 is connected to the waste liquid holding section 61 via a discharge tube 62. Note that, it is preferable to dispose the suction mechanism 54 in a position that is closer to the upstream side in the transport direction Y than the first reception section 52 and the waste liquid holding section 61, and is closer to the first end P1 than the waste liquid holding section 61 in the width direction (the rear side of the first reception section 52).

Figure 5:
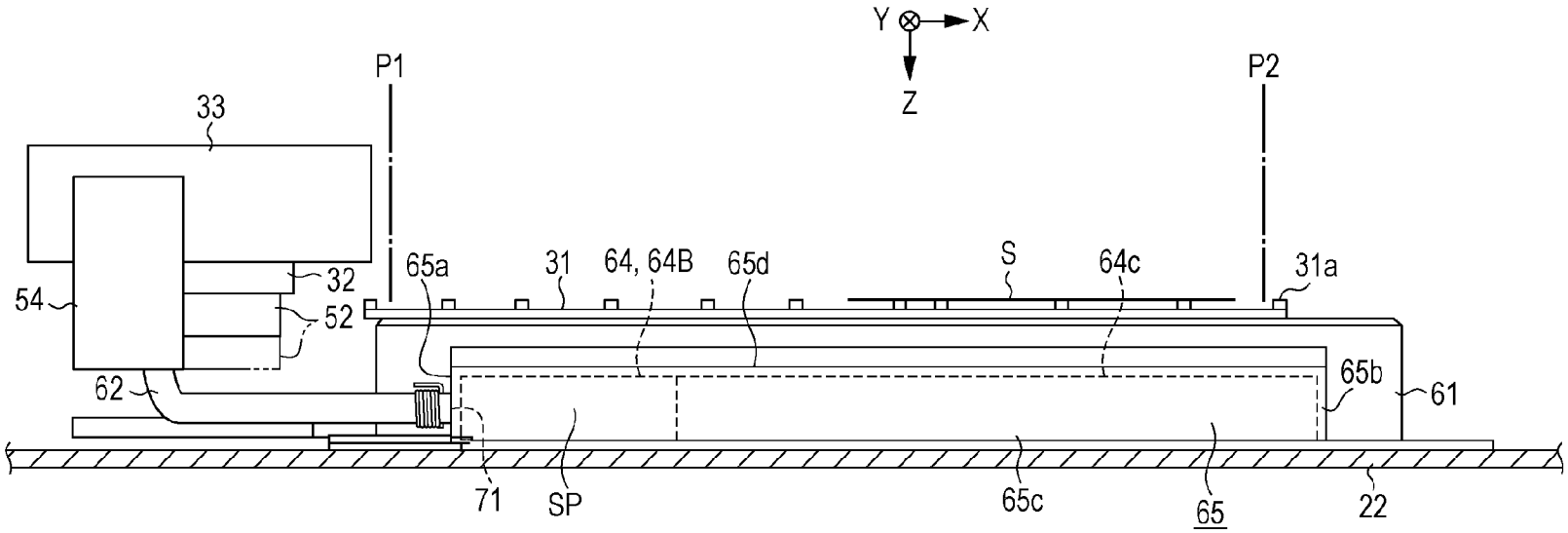
FIG. 5 is a schematic diagram of the configuration of the maintenance apparatus as viewed from a rear side.

The first reception section 52 is capable of moving along the ejection direction Z, and moves between a capping position (the position illustrated by the solid line in FIG. 5), and a withdrawn position (the position illustrated by the double-dot-dash line in FIG. 5). In the capping position, the first reception section 52 is in contact with the liquid ejecting unit 32 that is in the home position, and in the withdrawn position, the first reception section 52 is closer to the bottom wall 22 than in the capping position.

When the first reception section 52 moves to the capping position in which the first reception section 52 is in contact with the liquid ejecting unit 32, the first reception section 52 forms a closed space to which the nozzles 35 are open. In this manner, forming the closed space to which the nozzles 35 are open using the first reception section 52 is referred to as "capping". Note that, when the first reception section 52 is moved from the capping position to the withdrawn position, the capping is released.

When the atmosphere release valve 56 is displaced to an open-valve position in which the distal end of the ventilation tube 55 is open, the closed space formed by the first reception section 52 assumes a state of being communicated with the atmosphere. When the atmosphere release valve 56 is displaced to a closed-valve position in which the distal end of the ventilation tube 55 is blocked, the closed space enters a sealed state, and drying of the nozzles 35 is suppressed. When the power source is turned off or the like, and a state is assumed in which the liquid will not be ejected, the liquid ejecting unit 32 moves to the home position and waits in a state in which the first reception section 52 is moved to the capping position to performs the capping, and the atmosphere release valve 56 blocks the distal end of the ventilation tube 55.

An example of the suction mechanism 54 is a suction pump formed of a tube pump or the like which generates suction force due to a pressing member moving while crushing an elastically deformable tube. When the suction mechanism 54 drives while the atmosphere release valve 56 is in the closed-valve position, the pressure of the closed space is reduced, and the closed space assumes a negative pressure. Accordingly, suction cleaning in which the liquid is discharged from the liquid ejecting unit 32 through the nozzles 35 is executed. Note that, when the suction mechanism 54 is a tube pump, since it is possible to cause the closed space to communicate with the atmosphere by releasing the crushing of the tube by the pressing member, in this case, the atmosphere release valve 56 and the ventilation tube 55 may not be provided.

When an ejection fault of the liquid occurs due to the nozzles 35 clogging or the like, for example, the suction cleaning is performed as a maintenance operation to solve the ejection fault. Therefore, the liquid that is discharged from the nozzles 35 by the suction cleaning is held in the waste liquid holding section 61 through the discharge tube 62 as a waste liquid containing bubbles, the solute component of the liquid, or the like that enter the liquid ejecting unit 32.

After executing the suction cleaning, the atmosphere release valve 56 is displaced to the open-valve position to release the negative pressure of the closed space, and the capping is released by causing the first reception section 52 to move relative to a direction away from the liquid ejecting unit 32. Subsequently, air suction, which collects the liquid remaining in the first reception section 52 in the waste liquid holding section 61 by driving the suction mechanism 54, is performed.

There is a case in which flushing, in which the liquid ejecting unit 32 ejects the liquid toward the first reception section 52 which is in the withdrawn position, is performed as a maintenance operation for solving the ejection fault. Note that, the air suction, which collects the liquid received by the first reception section 52 in the waste liquid holding section 61 by driving the suction mechanism 54, is performed after performing the flushing.

A plurality of support protruding portions 31*a* which support the medium S are provided on the medium supporting section 31 so as to line up in the scanning direction X and the transport direction Y. A sheet holding concave portion 31*b* is provided in the surface of the top surface side (the vertical top surface) of the medium supporting section 31. A droplet reception sheet is held in the sheet holding concave portion 31*b* as a second reception section 38 capable of absorbing the liquid.

When performing the borderless printing in which printing is carried out to the edges of the medium S without margins, the second reception section 38 receives the droplets which are ejected from the liquid ejecting unit 32 toward the edge portions of the medium S, not been received by the medium S, and fallen outside thereof.

In other words, when the direction intersecting the transport direction Y is the width direction, the liquid ejecting unit 32 ejects the liquid onto the medium S that is transported in the transport direction Y in a state of the edge portion position thereof being aligned with the second end P2 side, of the first end P1 and the second end P2 in the width direction of the transport path. The medium supporting section 31 includes the support protruding portions 31*a*, and the second reception section 38, and is disposed in the transport path. The support protruding portions 31*a* support the medium S, and the second reception section 38 receives the liquid that is ejected from the liquid ejecting unit 32 toward the edge portions of the medium S and is not received by the medium S as the waste liquid. In contrast, the first reception section 52 is disposed on the outside of the first end P1 of the transport path and receives the liquid from the liquid ejecting unit 32 as the waste liquid. The waste liquid holding section 61 holds the waste liquid that is received by the first reception section 52 and the second reception section 38.

Figure 4:
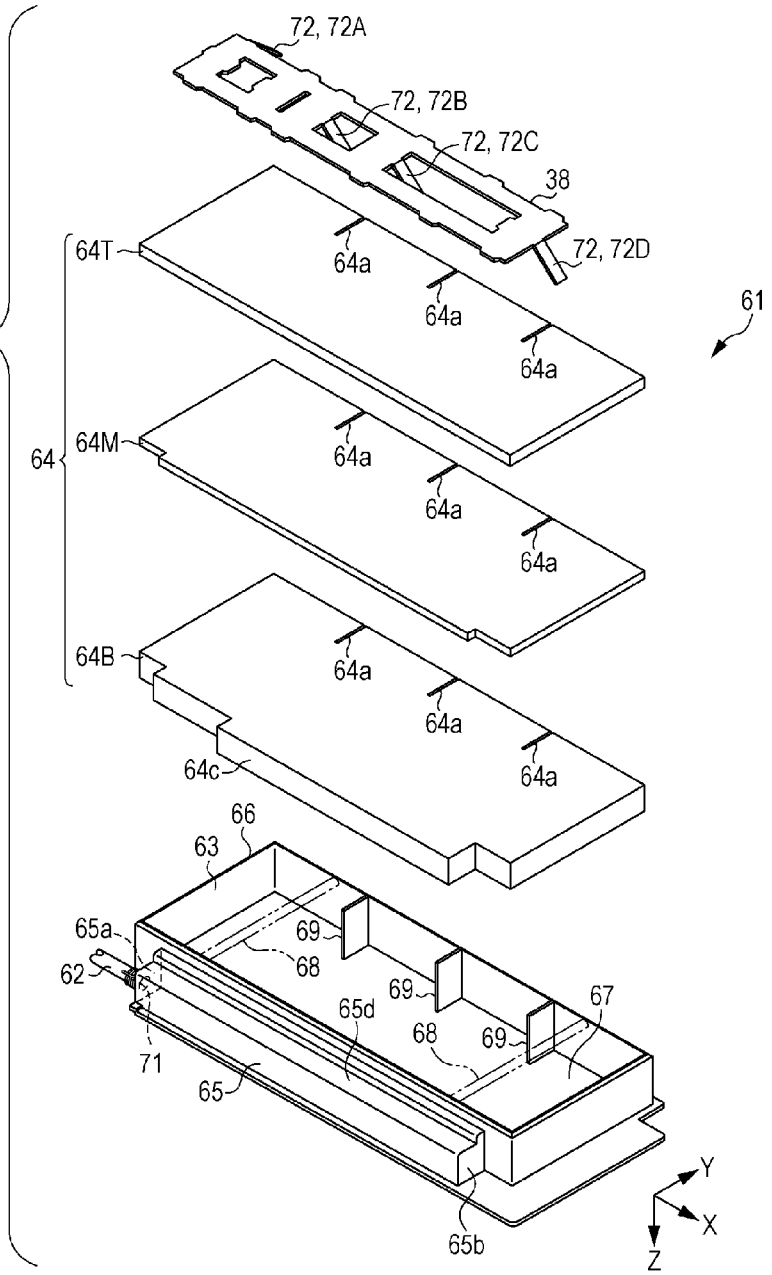
FIG. 4 is a diagram illustrating an exploded perspective of a waste liquid holding section, and illustrating a perspective of a second reception section.

As illustrated in FIG. 4, the waste liquid holding section 61 is provided with a holding concave portion 63, an absorbent bodies 64 (64T, 64M, 64B), and a space forming portion 65. The holding concave portion 63 is open vertically upward, the absorbent bodies 64 is capable of absorbing the waste liquid that is held in the holding concave portion 63, and the space forming portion 65 communicates with the holding concave portion 63. An opening portion 66 which is open vertically upward in the holding concave portion 63 is an opening portion that opens toward the second reception section 38, and the internal space of the holding concave portion 63 forms a holding chamber 67 which holds the waste liquid vertically below the medium supporting section 31 (refer to FIG. 6). In the present embodiment, the space forming portion 65 is positioned further down vertically than the opening portion 66. Note that, in the present embodiment, the absorbent bodies 64T, 64M, and 64B are laminated in the vertical direction; however, the number, the size, and the shape of the absorbent bodies 64 held in the holding concave portion 63 can be arbitrarily modified.

It is preferable that a retaining member 68 for suppressing the expansion and movement of the absorbent body 64 is disposed in the vicinity of the opening portion 66 of the holding concave portion 63. The retaining member 68 may be bar members as illustrated in FIG. 4, and a film-shaped retaining member may be disposed on the top surface side of the absorbent body 64T.

It is preferable that one or a plurality of protruding portions 69 which protrude into the holding concave portion 63 is provided in the waste liquid holding section 61, that slits 64*a* into which it is possible to insert the protruding portions 69 are provided in the absorbent bodies 64, and that the protruding portions 69 are inserted into the slits 64*a* in the absorbent bodies 64. By adopting this configuration, it is possible to suppress the movement of the absorbent bodies 64 in the holding chamber 67. Note that, it is possible to arbitrarily modify the position, the number, and the shape of the protruding portions 69.

As illustrated in FIG. 5, the space forming portion 65 includes a pair of side walls 65*a* and 65*b*, a bottom wall 65*c*, and a ceiling portion 65*d*. The pair of side walls 65*a* and 65*b* are disposed to face each other in the width direction, where the width direction (the scanning direction X) is the longitudinal direction, and the bottom wall 65*c* and the ceiling portion 65*d* intersect the pair of side walls 65*a* and 65*b* and extend in the width direction (the scanning direction X). An inlet 71 (also refer to FIG. 4) for guiding in the waste liquid that is received by the first reception section 52 is provided in the side wall 65*a*, which is one of the pair of side walls 65*a* and 65*b*. The downstream end of the discharge tube 62 is connected to the inlet 71.

It is preferable that the inlet 71 of the present embodiment is open toward a direction parallel to the width direction in the side wall 65*a*, which is the closer of the pair of side walls 65*a* and 65*b* to the first reception section 52. If this configuration is adopted, the inlet 71 assumes a mode of being disposed in a position closer to the first end P1 than the second end P2, of the first end P1 and the second end P2 in the width direction, in the transport path of the medium S, and this is adopted because it is possible to reduce the length of the discharge tube 62.

Figure 6:
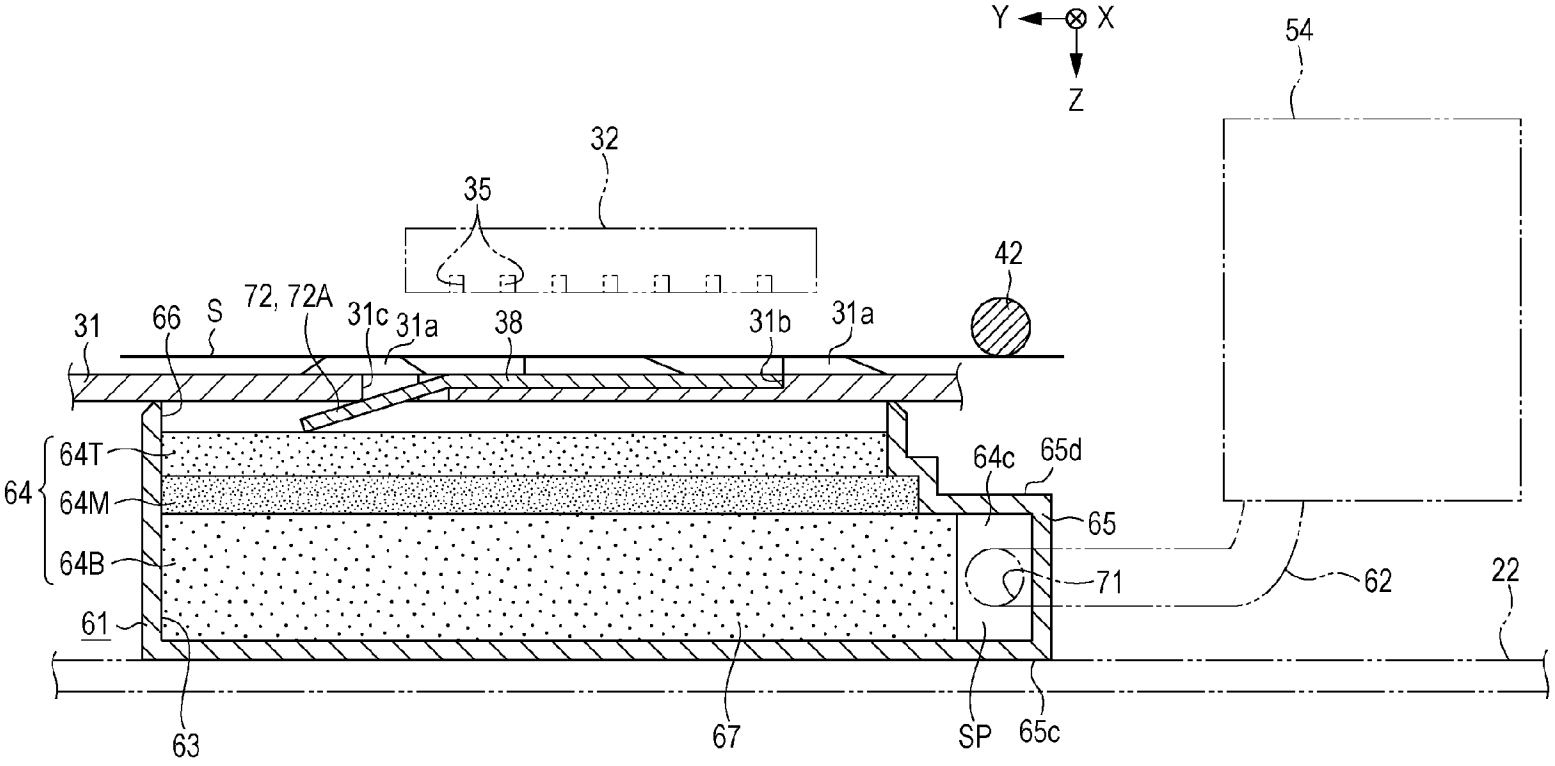
FIG. 6 is a schematic cross sectional diagram illustrating the configurations of the waste liquid holding section, the medium supporting section, and the second reception section.

As illustrated in FIG. 6, the holding concave portion 63 of the waste liquid holding section 61 is disposed between the medium supporting section 31 and the bottom wall 22 in the ejection direction Z. Note that, FIG. 6 is a diagram schematically illustrating the cross-sections of the waste liquid holding section 61, the medium supporting section 31, and the second reception section 38 that are cut at the position indicated by the arrow VI-VI in FIG. 7.

The space forming portion 65 of the waste liquid holding section 61 is disposed between the transport roller 42 and the bottom wall 22 in the ejection direction Z. The space forming portion 65 of the waste liquid holding section 61 is disposed in the space that is formed vertically beneath the transport roller 42 that is disposed closer to the upstream side in the transport direction Y than the medium supporting section 31. Therefore, the inlet 71 of the waste liquid holding section 61 assumes a mode of being disposed vertically beneath the transport roller 42 which configures the transport unit 41. Note that, the transport roller 42 is disposed to be adjacent to the medium supporting section 31 in the transport direction Y.

The absorbent body 64B includes an extending portion 64*c* (also refer to FIG. 4) which extends from the holding concave portion 63 toward the inside of the space forming portion 65. The extending portion 64*c* is cut out at the end portion of the inlet 71 side in the width direction. Accordingly, the space forming portion 65 forms a space SP (refer to both FIGS. 5 and 7) between the absorbent bodies 64 and the inlet 71 in the portion from which the extending portion 64*c* is cut out.

A plurality of through-holes 31*c* are formed in the medium supporting section 31 at positions corresponding to the inner bottom portion of the sheet holding concave portion 31*b*. Liquid guiding portions 72 which are inserted through the through-holes 31*c* are connected to the second reception section 38. In each of the liquid guiding portions 72, the base end, which is the top end, is connected to the second reception section 38, and the distal end, which is the bottom end, is inserted into the opening portion 66 and makes contact with the absorbent body 64T. The liquid that is received by the second reception section 38 is guided along the liquid guiding portions 72 into the holding chamber 67, and is absorbed by the absorbent body 64.

Figure 7:
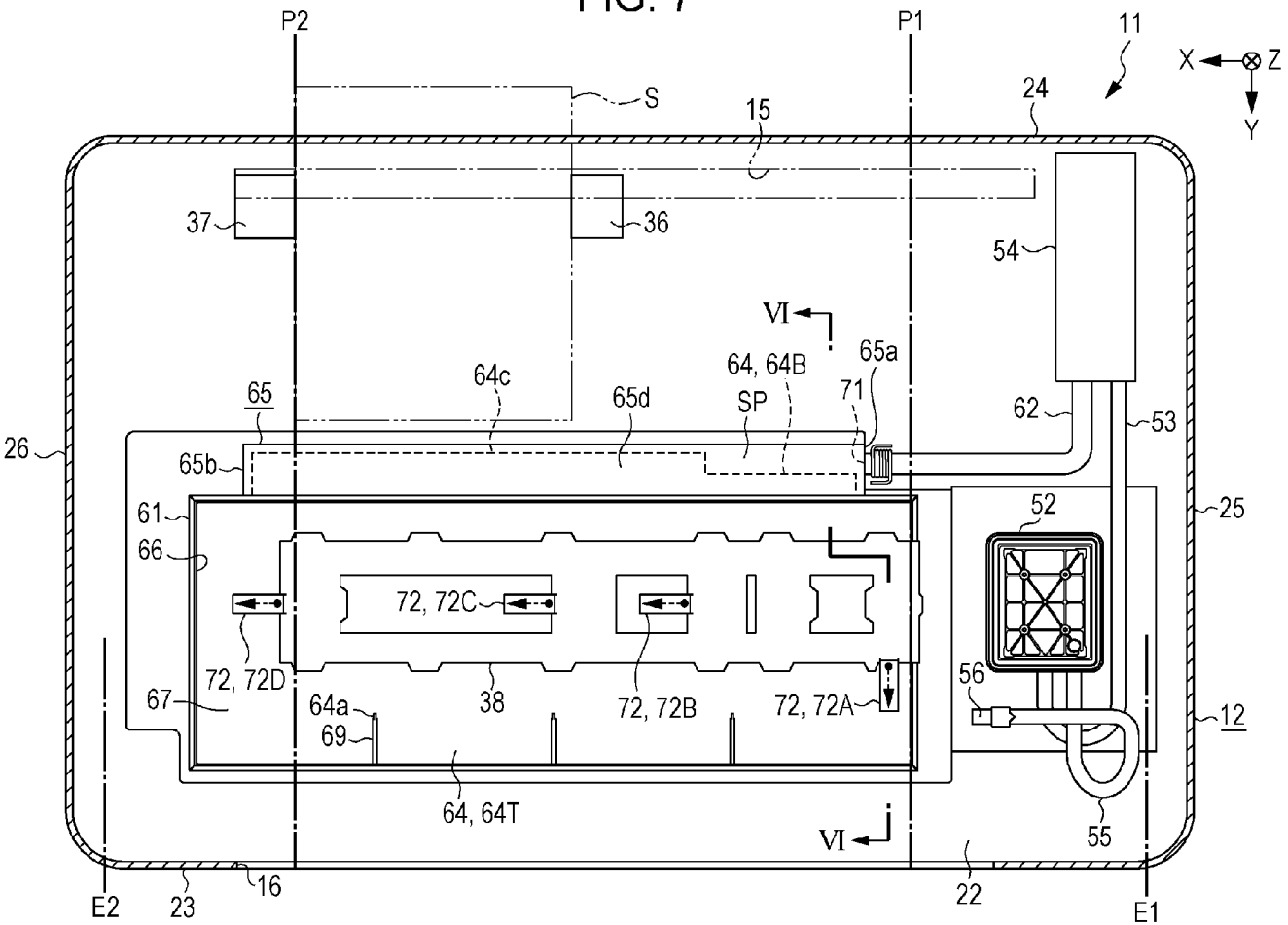
FIG. 7 is a schematic diagram illustrating the planar configurations of the waste liquid holding section, the medium supporting section, and the second reception section.

As illustrated in FIG. 7, each of the liquid guiding portions 72 is disposed in a position in which the distal end is further from the inlet 71 than the base end in the direction that intersects the vertical direction. For example, of the four liquid guiding portions 72 (72A, 72B, 72C, and 72D) which are connected to the second reception section 38 of the present embodiment, the liquid guiding portion 72 in a position closest to the first reception section 52 extends in the transport direction Y from the base end (the black circle position of the arrow of FIG. 5) toward the distal end (the distal end of the same arrow). The distal end of the liquid guiding portion 72A is in a position further from the inlet 71 than the base end in the transport direction Y which intersects the vertical direction.

The liquid guiding portions 72B, 72C, and 72D extend in the width direction (the scanning direction X). Each distal end of the liquid guiding portions 72B, 72C, and 72D is in a position further from the inlet 71 than the base side in the scanning direction X which intersects the vertical direction. Note that, in FIG. 7, in order to clearly illustrated the configurations of the waste liquid holding section 61 and the second reception section 38, depiction of the medium supporting section 31 and the transport unit 41 is omitted.

Next, description will be given of the effects of the liquid ejecting apparatus 11, which is configured as described above.

In the liquid ejecting apparatus 11, the droplets that fall outside of the edge portions of the medium S when performing the borderless printing are received by the second reception section 38, travel along the liquid guiding portions 72, and are held in the holding chamber 67 of the waste liquid holding section 61 from the opening portion 66. The waste liquid that is discharged from the liquid ejecting unit 32 into the first reception section 52 for the maintenance of the liquid ejecting unit 32 flows through the discharge tube 62 due to the driving of the suction mechanism 54, and is held in the holding chamber 67 of the waste liquid holding section 61 from the inlet 71.

In other words, the waste liquid that is generated in the transport path of the medium S and is received by the second reception section 38, and the waste liquid that is generated outside of the transport path of the medium S and is received by the first reception section 52 respectively pass through the opening portion 66 and the inlet 71, which are entrances disposed in different positions, and are guided into the waste liquid holding section 61. Therefore, it is possible to simplify the configuration in comparison with a case in which the waste liquid holding section which holds the waste liquid that is generated in the transport path and the waste liquid holding section which holds the waste liquid that is generated outside of the transport path are provided separately.

Here, since the medium S is transported in a state in which the edge portion positions thereof are aligned with the second end P2 side of the transport path, when printing is performed on a plurality of media S of differing sizes in the width direction, although the position at which the droplets that fall outside of the edge portions of the first end P1 side in the second reception section 38 will vary, the position at which the droplets that fall outside of the edge portions of the second end P2 side will be substantially coincidental. Therefore, there is a high likelihood that the second reception section 38 will receive more of the waste liquid at a position closer to the second end P2 than the first end P1.

As a result, the amount of the waste liquid received by the second reception section 38 which travels along the liquid guiding portion 72D in the position close to the second end P2 and is held by the holding chamber 67 is greater than that which travels along the liquid guiding portions 72A, 72B, and 72C which are in positions close to the first end P1 in the width direction (the scanning direction X).

Meanwhile, the waste liquid received by the first reception section 52 is held in the holding chamber 67 through the inlet 71 in a position close to the first end P1 in the width direction (the scanning direction X) of the space forming portion 65 which is provided in the waste liquid holding section 61. While the space forming portion 65 is disposed on the upstream side of the waste liquid holding section 61 in the transport direction Y, conversely, the distal ends of the liquid guiding portions 72 which are in contact with the absorbent bodies 64 are in positions further from the inlet 71 than the base ends which are connected to the second reception section 38.

In this manner, the distal ends of the liquid guiding portions 72 which guide the waste liquid received by the second reception section 38 into the absorbent bodies 64, and the inlet 71 for guiding the waste liquid received by the first reception section 52 into the holding chamber 67 are disposed in positions that are as distanced from each other as possible in the transport direction Y and in the width direction. While the waste liquid which travels along and falls from the liquid guiding portions 72 is absorbed from the top surface side of the absorbent body 64T, the waste liquid which is guided in from the inlet 71 spreads along the bottom surface in the space SP in a wet-spreading manner, and is subsequently absorbed from the bottom surface side of the absorbent body 64B. Therefore, it becomes possible to efficiently absorb the waste liquid that is generated inside of the transport path and the waste liquid that is generated outside of the transport path from positions that are distanced from each other in the absorbent bodies 64.

By providing the opening portion 66 in a position close to the second reception section 38 for guiding the waste liquid that is received by the second reception section 38 into the holding chamber 67 in the waste liquid holding section 61, it becomes possible to miniaturize the liquid guiding portions 72. By providing the inlet 71 for guiding the waste liquid that is received by the first reception section 52 into the holding chamber 67 in a position close to the first reception section 52, it becomes possible to shorten the length of the discharge tube 62. Therefore, the waste liquid that is received by the second reception section 38 and the waste liquid that is received by the first reception section 52 are efficiently collected in the waste liquid holding section 61.

According to the embodiment described above, it is possible to obtain the following effects.

(1) Since the inlet 71 of the waste liquid holding section 61 is disposed in a position that is closer to the first end P1 than the second end P2, it is possible to efficiently guide the waste liquid that is discharged from the first reception section 52 which is disposed outside of the first end P1 of the transport path into the holding chamber 67 through the inlet 71. Since the opening portion 66 of the waste liquid holding section 61 is open toward the second reception section 38, it is possible to efficiently guide the waste liquid that is received by the second reception section 38 into the holding chamber 67 through the opening portion 66. Since the medium S is transported in a state in which the edge portion position thereof is aligned with the second end P2 side of the transport path, there is a high likelihood that more of the waste liquid will be generated at a position closer to the second end P2 than the first end P1 in the transport path. Therefore, in the holding chamber 67, the waste liquid that is generated within the transport path is collected in a prioritized manner at a position near to the second end P2, and the waste liquid that is generated outside of the transport path is collected in a prioritized manner at a position near to the first end P1. Therefore, it is possible to efficiently collect the waste liquid that is generated within the apparatus.

(2) By disposing the space forming portion 65 and the inlet 71 of the waste liquid holding section 61 vertically below the transport roller 42 which forms the transport unit 41, it is possible to secure a wide space for disposing the holding chamber 67 vertically beneath the medium supporting section 31.

(3) By allowing the waste liquid to travel from the base ends toward the distal ends of the liquid guiding portions 72, it is possible to guide the waste liquid that is received by the second reception section 38 into the holding chamber 67 through the opening portion 66. Since the liquid guiding portions 72 are disposed in positions at which the distal ends are further from the inlet 71 than the base ends in a direction intersecting the vertical direction, it is possible to distance the position at which the waste liquid that is generated in the transport path is held and the position at which the waste liquid that is generated outside of the transport path is held in the waste liquid holding section 61. Accordingly, in the waste liquid holding section 61, it is possible to efficiently hold the liquid that is ejected from the liquid ejecting unit 32 toward the medium supporting section 31, and the waste liquid that is discharged from the liquid ejecting unit 32 on the outside of the transport path of the medium S.

(4) By allowing the waste liquid to flow into the space SP formed by the space forming portion 65, it is possible to perform the guiding of the waste liquid into the waste liquid holding section 61 quicker than in a case in which the absorbent body in a position abutting the inlet 71 is allowed to absorb the waste liquid. Due to the waste liquid that is guided in from the inlet 71 spreading in the space SP that is formed between the absorbent bodies 64 and the inlet 71, it is possible to increase the surface area of the absorbent bodies 64 in contact with the waste liquid and to cause the absorption of the waste liquid by the absorbent bodies 64 to progress quickly. Since, while the waste liquid that is discharged from the second reception section 38 is absorbed from the top surface side of the absorbent body 64T, the waste liquid that is discharged from the first reception section 52 is absorbed from the bottom surface side of the absorbent body 64B, it is possible to efficiently absorb the waste liquid that is generated inside of the transport path and the waste liquid that is generated outside of the transport path from positions that are distanced from each other in the absorbent bodies 64.

(5) By providing the inlet 71 in the side wall 65*a*, which is one of the pair of side walls 65*a* and 65*b* which face each other in the width direction which is the longitudinal direction of the space forming portion 65, it is possible to efficiently increase the contact surface area of the absorbent bodies 64 in relation to the waste liquid by allowing the waste liquid that is guided in from the inlet 71 to spread in the longitudinal direction of the space forming portion 65.

(6) Since the inlet 71 is provided in the side wall 65*a* that is close to the first reception section 52, of the pair of side walls 65*a* and 65*b*, it is possible to shorten the discharge tube 62 which forms the flow path connecting the first reception section 52 to the inlet 71 in comparison to a case in which the inlet 71 is provided in the side wall 65*b* which is far from the first reception section 52. Since the inlet 71 is open toward a direction parallel to the width direction, the flow path (the discharge tube 62) which connects the first reception section 52 to the inlet 71 is provided to extend from the inlet 71 toward the direction parallel to the width direction. Conversely, when the inlet 71 is open toward the upstream side or the downstream side in the transport direction Y, since the flow path (the discharge tube 62) is provided to extend along the transport direction Y, there is a high likelihood that the apparatus will be enlarged in the transport direction Y. In other words, by opening the inlet 71 toward a direction parallel to the width direction, it is possible to suppress the enlargement of the apparatus in the transport direction Y.

Furthermore, the embodiment described above may also be modified as in the modification examples described below.

In the waste liquid holding section 61, the position of the opening portion 66 and the position of the holding chamber 67 may be shifted in the transport direction Y or in the width direction.

The inlet 71 may be provided in the waste liquid holding section 61 to be open to the holding concave portion 63 without providing the space forming portion 65. For example, the inlet 71 may be provided on the side surface facing the first reception section 52 in the waste liquid holding section 61.

The liquid guiding portions 72 may be formed integrally with the second reception section 38, and may be formed distinctly from the second reception section 38 to be connected to the second reception section 38. Alternatively, the liquid guiding portions 72 may be provided to extend from the absorbent bodies 64 such that the distal ends of the liquid guiding portions 72 are in contact with the second reception section 38.

The positions, the sizes, and the shapes of the liquid guiding portions 72 may be arbitrarily modified. For example, only the liquid guiding portion 72D, which is in a position close to the second end P2 at which there is a high likelihood that much of the waste liquid will be received, may be provided. In this case, the opening portion 66 may be provided in a position at which it is possible to insert the distal end of the liquid guiding portion 72D.

The entirety of the internal space of the space forming portion 65 may be used as the space SP without disposing the absorbent bodies 64 (the extending portion 64*c*) therein.

The space forming portion 65 may be disposed vertically below the transport path forming member 46.

The holding concave portion 63 may be provided to extend to the region between the transport path forming member 46 and the bottom wall 22, or to the region between the discharge roller 43 and the bottom wall 22.

The first reception section 52 may be a flushing box which receives the droplets that are ejected from the liquid ejecting unit 32 without making contact with the liquid ejecting unit 32.

The waste liquid holding section 61 may be provided with a configuration that is attachable and detachable in relation to the liquid ejecting apparatus 11.

The inlet 71 of the waste liquid holding section 61 may be disposed vertically beneath a member other than the transport roller 42 which forms the transport unit 41. For example, the inlet 71 may be disposed between the transport path forming member 46 and the bottom wall 22 which is below the transport path forming member 46 in the vertical direction.

The space forming portion 65 may be disposed closer to the downstream side than the medium supporting section 31 in the transport direction Y, and the inlet 71 may be disposed between the discharge roller 43 and the bottom wall 22 which is vertically below the discharge roller 43.

The liquid that is ejected by the liquid ejecting unit 32 is not limited to an ink, and may be, for example, a liquid-state body in which particles of a functional material are dispersed or mixed into a liquid. For example, a configuration may be adopted in which the liquid ejecting apparatus performs recording by ejecting a liquid-state body which contains a material such as an electrode material or a color material (pixel material) in the form of a dispersion or a solution. The electrode material or the color material may be used in the manufacture or the like of liquid crystal displays, Electro-Luminescence (EL) displays, and surface emission displays.

The medium S is not limited to paper, and may be plastic film, thin plate material, or the like, and may also be a fabric used in a textile printing apparatus or the like.

The entire disclosure of Japanese Patent Application No. 2014-104054, filed May 20, 2014 is expressly incorporated by reference herein.

What is claimed is:

1. A liquid ejecting apparatus, comprising:

a liquid ejecting unit which ejects a liquid onto a medium, the medium being transported in a transport direction in a state in which an edge portion thereof is aligned with a second end side of a first end and the second end in a width direction intersecting the transport direction of a transport path;

a first reception section which is disposed at a position adjacent to the transport path and closer to the first end than the second end of the transport path, the first reception being capable of receiving the liquid that is discharged from the liquid ejecting unit as a waste liquid;

a medium supporting section which includes support protruding portions, the medium supporting section being capable of supporting the medium;

a second reception section which is disposed in the transport path, the second reception section being capable of receiving the liquid that is ejected from the liquid ejecting unit toward the edge portion of the medium and is not received by the medium as the waste liquid; and a waste liquid holding section which is capable of holding the waste liquid that is received by the first reception section and the second reception section, wherein the waste liquid holding section includes:

a holding chamber which holds the waste liquid received by the first reception section and the second reception section, the holding chamber being located vertically beneath the medium supporting section, an inlet which is disposed in a position closer to the first end than the second end, the inlet being configured to guide the waste liquid received by the first reception section into the holding chamber, and an opening which is open toward the second reception section, the opening being configured to guide the waste liquid received by the second reception section into the holding chamber.

2. The liquid ejecting apparatus according to claim 1, further comprising:

a transport unit which is disposed to be adjacent to the medium supporting section in the transport direction and transports the medium, wherein the inlet of the waste liquid holding section is disposed vertically below the transport unit.

3. The liquid ejecting apparatus according to claim 1, further comprising:

a liquid guiding portion, a base end of which is connected to the second reception section and a distal end of which is inserted into the opening of the waste liquid holding section, wherein the liquid guiding portion is disposed in a position at which the distal end is further from the inlet than the base end in the direction intersecting a vertical direction.

4. The liquid ejecting apparatus according to claim 1, wherein the waste liquid holding section includes a holding concave portion which is open vertically upward, an absorbent body capable of absorbing the waste liquid that is held in the holding concave portion, and a space forming portion which forms a space between the absorbent body and the inlet, and wherein an opening of the holding concave portion which is open vertically upward is the opening portion which is open toward the second reception section, and an internal space of the holding concave portion forms the holding chamber.

5. The liquid ejecting apparatus according to claim 4, wherein the space forming portion includes a pair of side walls which are disposed to face each other in the width direction, and wherein the width direction is a longitudinal direction of the space forming portion and the inlet is provided in one of the side walls.

6. The liquid ejecting apparatus according to claim 5, wherein the inlet is open toward a direction parallel to the width direction in the side wall that is near the first reception section, of the pair of side walls.

7. The liquid ejecting apparatus according to claim 4, further comprising:

a transport unit which is disposed to be adjacent to the medium supporting section in the transport direction and transports the medium, wherein the space forming portion is disposed vertically beneath the transport unit.

8. The liquid ejecting apparatus according to claim 4, wherein the space forming portion includes a bottom wall and a ceiling portion which extend in the width direction, and wherein the ceiling portion is positioned lower than a top surface of the absorbent body in a vertical direction.

9. The liquid ejecting apparatus according to claim 1, further comprising:

a suction mechanism which is disposed in a position that is closer to an upstream side in the transport direction than the first reception section and the waste liquid holding section and closer to the first end than the waste liquid holding section in the width direction, and which collects the waste liquid that is received by the first reception section in the waste liquid holding section via the inlet.

10. The liquid ejecting apparatus according to claim 1, wherein the first reception section is disposed capable of receiving the liquid discharged from the liquid ejecting unit in contact with the liquid ejecting unit.

* * * * *